United States Patent [19]

Cueman

[11] 4,048,818

[45] Sept. 20, 1977

[54] THERAPEUTIC STOCKING AND METHOD

[75] Inventor: Glenn F. Cueman, Charlotte, N.C.

[73] Assignee: Zimmer U.S.A., Inc., Warsaw, Ind.

[21] Appl. No.: 690,553

[22] Filed: May 27, 1976

[51] Int. Cl.[2] ..... D04B 9/52; D04B 9/54; D04B 9/56

[52] U.S. Cl. ..... 66/172 E; 66/173; 66/178 A; 66/185; 66/202

[58] Field of Search ..... 66/178 A, 178 R, 177, 66/190, 202, 185, 186, 187, 172 E, 173; 2/240

[56] References Cited

U.S. PATENT DOCUMENTS

| | | | |
|---|---|---|---|
| 2,960,751 | 11/1960 | Reymes-Cole | 66/185 X |
| 2,990,704 | 7/1961 | Purcell | 66/178 R X |
| 3,250,092 | 5/1966 | York et al. | 66/178 A X |
| 3,443,404 | 5/1969 | Knohl | 66/178 A |
| 3,567,565 | 3/1971 | Jones et al. | 66/190 X |
| 3,590,390 | 7/1971 | Howard | 2/240 X |
| 3,728,875 | 4/1973 | Hartigan et al. | 66/178 A X |
| 3,889,494 | 6/1975 | Patience et al. | 66/178 A |

*Primary Examiner*—Wm. Carter Reynolds

[57] ABSTRACT

A circular knit therapeutic stocking in which bare elastomeric yarn is knit in selected courses and wales with a non-elastomeric yarn in other selected courses and wales in the welt, boot and foot portions of a stocking to provide a retractive or compressive force of graduating degrees as required with a circumferential heel-instep band of lesser retractive or compressive force, and a closed toe area in which stretchable fabric with minimal retractive forces is integrally knit to the foot portion of the stocking whereby the bare elastomeric yarns are buried or concealed by the knitted non-elastomeric yarns and in which a welt panel of flexible and relatively non-stretchable material is secured in the welt portion of the stocking to be positioned on the inner upper thigh of the leg of a wearer. The inner surface of the welt panel being lined with polyurethane foam or similar material which would have a high coefficient of friction against the skin in order to help maintain the stocking in position on the leg of a wearer.

4 Claims, 7 Drawing Figures

THERAPEUTIC STOCKING AND METHOD

BACKGROUND, OBJECTIVES AND ADVANTAGES OF THE INVENTION

Men and women suffer from edema and complications of phlebitis and Stasis ulcers as well as other venous inflammatory diseases during protracted bed confinement whether from accidents, fractures or extended illnesses. Post surgical convalescence for certain patients prescribes wearing some form of elastic bandages, elastic surgical support stockings or other means for preventing conditions of phlebitis or other venous inflammatory conditions and possible complications that may be developed in non-ambulatory or disabled patients.

Women during prenatal and postnatal care have experienced a tendency to encounter swelling and pain in their legs generated by edema and have found a measure of relief by wearing some types of support or surgical stockings. Others who have experienced "tired legs" have found some relief by wearing hosiery that has a degree of retractive or compressive force.

The above-noted application describes a therapeutic garment that is knit with bare elastomeric and non-elastomeric yarns which seeks to overcome some of the disadvantages and objections to certain of the presently available commercial products.

Many of the objections encountered by women particularly in wearing surgical support stockings or elastic bandages has been generated by the objectionable appearance of the rather course construction of the leg coverings on the leg of a wearer.

With the introduction of torque thermoplastic yarns and other textured yarns that have been available in more recent years, stretchable nylon stockings have afforded wearers a measure of retractive or compressive force when properly proportioned to the leg volume of the wearer. Elastomeric yarns have also been used advantageously in support-type stockings in combination with stretchable nylon yarns usually with the spandex yarns being covered and laid-in or knit-in in selected courses of the stocking. In some types of support stockings, covered spandex yarns have been employed rather extensively to provide a desired degree of retractive force. Some stockings have been produced in which bare spandex has been laid-in without providing the high compressive forces disired or the graduated retractive forces throughout the leg of the wearer in the vital regions below the knee as well as above the knee.

Most support stocking that are generally available commercially have also been found to be objectionable by reason of the lack of control of the tension in the yarns to provide graduated degrees of retractive force in the foot, ankle, calf, knee and thigh areas on the leg of the wearer. Furthermore, no provision has been made to relieve the compressive force about the toe area for increased comfort.

In those support stockings that have employed bare spandex or elastomeric yarns, such yarns have been exposed to the leg of the wearer and provide an objectionable clammy or rubber feel or hand. Spandex yarns tend to snag readily when exposed, and minimal abrasion has resulted in severance and deterioration of the entire stocking when one or more of the spandex yarns is ruptured or severed in any portion of the stocking.

There is also a further objection in the use of many surgical support stockings as well elastic bandages which have tended to overlap or wrinkle in the instep portion and thereby pinch the wearer's skin after protracted periods of use.

It has also been determined that for some patients suffering from edema and complications such as phlebitis, thrombophlebitis and other complications that develop in chronically disabled patients that the binding action of the welt portion of a stocking must be adjusted for either greater or less compressive or retractive forces. Some approaches have been made in this area and the present invention is directed toward still another approach to achieve the objective of relieving or overcoming objections to pesently available support or surfical stockings. Other objections to the use of stockings of this type include the tendency of the thigh-length versions to roll or slide down the leg of the wearer.

It is an objective of this invention to provide a therapeutic stocking in which spandex or elastomeric yarns are knit in conjunction with non-elastomeric yarns to provide a retractive or compressive force on the leg of a wearer and to incorporate a soft and flexible but relatively inelastic panel in the welt portion of the stocking to provide a compressive force on the upper inner thigh area on the leg of a wearer. This welt insert would be lined with a material such as polyurethane foam which would provide resistance to rolling down as well as provide a high coefficient of friction which would inhibit the tendency to slide down the leg, as this region of the stocking exerts very low pressure on the limb.

Another objective of this invention is to provide a therepeutic stocking that is made on a circular knitting machine using elastomeric and non-elastomeric yarns for a relatively sheer stocking to be worn by patients and others having venous inflammatory diseases and in which the welt portion is provided with an insert panel having a relatively soft inner surface which contacts the upper inner thigh of the wearer and in which the insert panel in the welt portion is relatively inelastic and may be worn for prolonged periods to alleviate leg pain and swelling.

Still another objective of this invention is to provide a therepeutic stocking in which elastomeric and non-elastomeric yarns are knit on a circular knitting machine under suitable tensions to provide graduated compressive retractive forces throughout the stocking when on the leg of a wearer and in which the welt portion of the stocking is provided with a relatively inelastic but highly flexible and soft insert panel securely fastened to an opening in the welt portion.

Yet another objective of this invention is the provision of a process for producing a therapeutic stocking knit of elastomeric and non-elastomeric yarns having a welt portion with a welt insert panel that is relatively soft and inelastic to provide a suitable retractive force on the inner upper thigh area on the leg of a wearer.

Other objectives of this invention and many of the attendant advantages will become more readily apparent to those skilled in the knitting art from the following detailed description of a preferred embodiment taken in conjunction with the accompanying drawing and detailed description of the therapeutic stocking and method of producing it.

DESCRIPTION OF THE DRAWING FIGURES

DETAILED DESCRIPTION OF PREFERRED EMBODIMENT OF THE INVENTION AND METHOD

Figure 1:
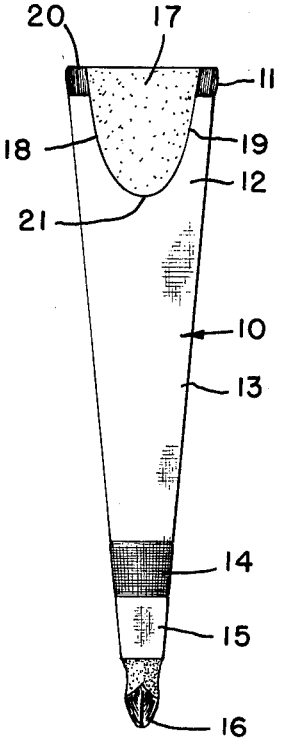
FIG. 1 is a side elevational view of a therapeutic stocking having a thigh panel welt insert embodying this invention.
Figure 2:
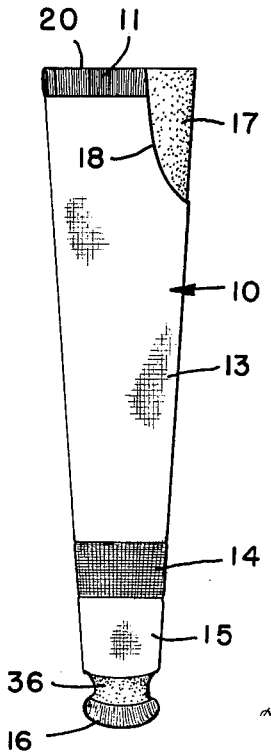
FIG. 2 is a left side elevational view of FIG. 1.

Referring to FIGS. 1 and 2 of the drawing, there is illustrated a therapeutic stocking 10 that is provided with an upper turned welt portion 11, an upper welt portion 12, a leg or boot portion 13, and intermediate heel-instep portion 14 combined with a section of the foot portion 15 at the end of which is a closed toe section 16, all of which sections and portions are integrally knit on a circular multi-feed knitting machine.

A flexible and relatively inelastic welt panel insert 17, having a substantially triangular or cone-shaped configuration is securely fastened to the opposed edges 18 and 19 formed in the welt portion 12 extending downwardly from the terminal end 20 of the welt to a position 21 that is above the conventional position for the knee of the leg of a wearer of the stocking. The panel insert 17 converges downwardly to be positioned on the upper and inner thigh portion on the leg of a wearer.

The tapered therapeutic sotcking 10 shown in FIGS. 1 and 2 is knit as a cylindrical tube without any reciprocation to form a heel pocket or toe pocket as in the conventional stocking. The therapeutic stocking 10 is provided with a taper by virtue of graduated stitch length control incorporated on the circular knitting machine and the finished stocking is preferably unboarded.

It has been determined that improved elasticity and retractive force of a knitted fabric utilizing spandex yarns is more desirable as opposed to heat-setting the knitted fabric and stitches when all thermoplastic yarns of spandex, nylon and polyester are employed. Furthermore, there is less tendency for any coalescing of the spandex and other thermoplastic yarns which may occur at elevated temperatures during boarding. In those cases in which cotton yarns are knit in combination with the spandex yarns, only the spandex yarns would be heat-set at the appropriate temperature while the cotton yarns in the knitted fabric would simply be pressed and would not remain pressed or set after washing in contrast to the thermoplastic spandex yarn stitch configuration which would heat-set depending upon the setting temperature for the particular spandex yarn knit in the fabric.

It has also been found desirable for one specific therapeutic stocking to employ multifilament nylon yarns to which has been imparted stretch characteristics by any of the known processes of imparting stretch as by false twisting in order to achieve the desired yarn stretch in the knitted fabric. While the denier of the nylon yarn may vary, it has been found desirable eo employ 70 denier multifilament stretchable or textured nylon yarn in selected courses and wales with preferably a single ply of yarn. For heavier constructions that may be desirable, two-ply 70 singles totalling 140 denier may be combined. Other types of textured yarns may be employed depending upon the desired hand and covering factor in order to protect and conceal the bare elastomeric or spandex yarns that are knit in the therapeutic stocking.

The preferred spandex or elastomeric yarns employed to achieve the desired power or modulus of elasticity for the retractive or compressive force is duPont's type of 128 "LYCRA" 180 denier, knit with the non-elastomeric yarns as will be described hereafter. It has been further found desirable to achieve the desired retractive or compressive force to apply a tension of approximately 6 to 7 grams to the spandex yarns before reaching the yarn feed finger and knitting elements on the knitting machine where the tension will be increased but cannot be measured accurately. The tension applied to the 70 denier stetchable nylon yarn is approximately 3 grams before the yarn feed finger and knitting elements, and these elements will also increase the tension on the nylon yarn before the nylon yarn reaches the knitting elements and is knit into the fabric.

It has been found desirable to employ conventional Lonati 8-feed circular knitting machines which have been converted to 4-feed machines to produce the circular knit fabric in which alternate feeds supply non-elastomeric yarns, such as nylon, and intermediate feeds supply the spandex yarn to the knitting elements. Through proper needle selection and graduated stitch control, throughout at least the portions of the therapeutic stocking 10 in which the proper retractive or compressive force is to be obtained, the alternate non-elastomeric yarn feeds supply the nylon yarns to all of the 400 needles while the intermediate elastomeric yarn feeds supply the spandex yarns to every other needle in intermediate courses while floating the spandex yarn over alternate wales.

Figure 5:
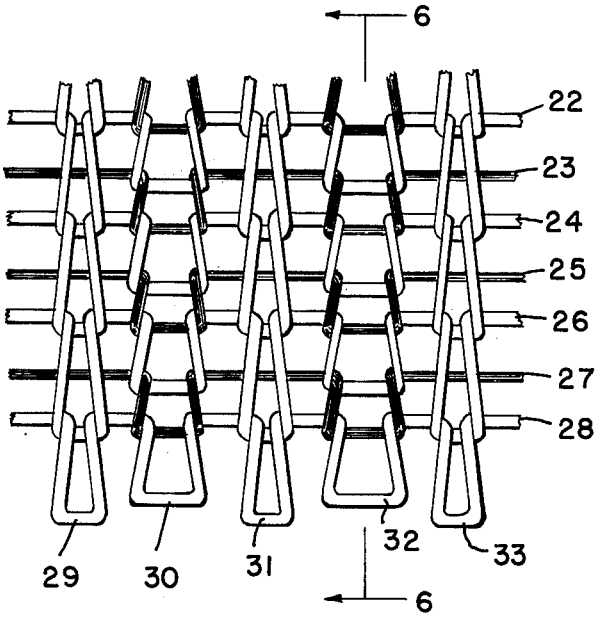
FIG. 5 is an enlarged diagrammatic view of the knitted structure of a portion of the circular knit fabric in the leg portion of the stocking of FIGS. 1 and 2.

As shown in FIG. 5, courses 22, 24, 26, and 28 represent the alternate courses in the welt, boot and leg potions of the foot of the stocking 10 which will provide the appropriate compressive force to the leg of a wearer in which non-elastomeric yarns are knit. The intermediate courses, 23, 25 and 27, include only the spandex yarns which are knit in intermediate wales 30 and 32, with the spandex yarns being floated past the alternate wales 29, 31, and 33.

Figure 6:
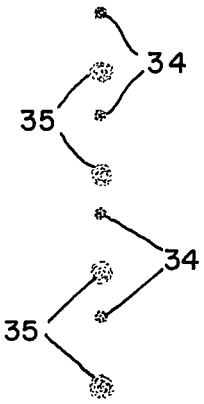
FIG. 6 is an enlarged transverse sectional view taken substantially along the 6—6 of FIG. 5 illustrating the yarn orientation in the fabric stretched condition.

In FIG. 6, there is illustrated schematically the positioning of the bare elastomeric yarns 34 in spaced relationship to the non-elastomeric yarns 35 when the fabric is in the stretched or extended condition. The stitch density is such that the spandex yarns 34 cannot readily be seen by the naked eye nor can they be felt either on the leg of the wearer or by hand. The relative sizes of the yarns used and the cover provided by the non-elastomeric yarns due to their bulk tend to conceal or hide the elastomeric yarns and prevent the elastomeric yarns from being abraded or readily snagged. There is little if any difference in placing or removing the stocking of this construction on or off the leg of a wearer despite the significant amount of spandex yarn used to obtain the power and modulus to achieve the support characteristics and therapeutic value desired recognizing that bare spandex yarn has a tendency to cling and resist slippage due to its relatively high frictional coefficient.

Figure 7:
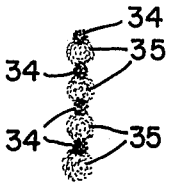
FIG. 7 is an enlarged transverse sectional view similar to FIG. 6 but illustrating the fabric in a substantially relaxed condition in which the larger non-elastomeric yarns substantially conceal from view the elastomeric yarns.

There is illustrated in FIG. 7 a greatly enlarged cross-sectional area of a portion of the stocking fabric illustrating the positioning of the elastomeric yarns 34 and the non-elastomeric yarns 35 in the fabric relaxed condition in which there is a tendency for the textured non-elastomeric yarns to conceal or be compacted against the elastomeric yarns and thereby protect them.

Figure 3:
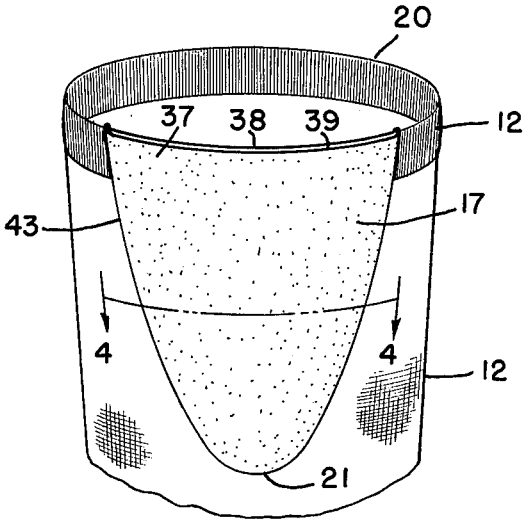
FIG. 3 is an enlarged partial prospective view of the top portion of the therapeutic stocking illustrating the thigh panel welt insert.

A medium size therapeutic stocking 10 including welt and closed toe as illustrated in FIGS. 2 and 3 is approximately 29 inches long in the relaxed and unboarded condition. The relaxed width of the stocking in the area adjacent to the lower tapered portion in the section 15 is 3⅛ inches wide in the flattened condition. The width of the relaxed flattened stocking in the leg portion immediately adjacent to the bottom of the panel insert 17 at the apex 21 is 4¼ inches wide in flattened condition. The flattened and unboarded stocking knit of 70 denier stretched nylon yarn and 180 denier "LYCRA" yarn is 3¾ inches in width at a position half the length of the stocking.

In order to provide increased comfort without binding and elminate heel reciprocation in order to achieve optimum compressive control in the heel-instep area portion 14, a circumferential band that is approximately 2 inches in length is integrally knit to provide increased stitch length relative to adjacent portions of the fabric whereby the relaxed portion 14 measures 3½ inches in the medial portion, approximately ¼ inch greater than the adjacent fabric sections. This heel-instep portion 14 will readily accommodate the heel of the wearer and the instep without undue stress, wrinkling of the fabric and binding.

The section 16 in the toe portion of the foot is knit preferably of stretchable 70 denier nylon yarn for improved wear resistance and the toe end is closed by a conventional overedge seam. In order to provide increased comfort of the stocking in the toe area on the foot of a wearer, the intermediate section 36 is knit using 20 denier stretchable nylon yarn on all needles without incorporating any spandex yarn in order to provide a non-binding integrally knit foot portion.

The density of knitted stitches made from elastomeric and non-elastomeric yarns of the therapeutic stocking will vary somewhat from stocking to stocking. However, in order to accommodate the different sizes of leg lengths and volume, it has been determined that four separate sizes in each category of lengths for short, regular, and long be provided in which there will be small, medium, large and extra large sizes in each length category. The length of the toe portion 16 will be standard and range within approximately ¾ of an inch. The band 36 will be approximately 1 inch in length. The section 15 will vary from 3 inches to 4¼ inches in each length category. The heel-instep section 14 will have a length that will vary from 2 inches to 2¼ inches for the four sizes in each length category. The length of the leg including welt will vary from 20 inches to longer lengths depending upon the volume and length of the leg of the wearer. The turned welt portion will be approximately 1 inch in length, and the same knitted construction will be present through the therapeutic stocking except as indicated above.

Figure 4:
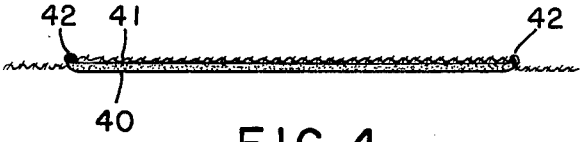
FIG. 4 is an enlarged transverse sectional view taken substantially along the line of 4—4 of FIG. 3.

Upon completion of the knitted therapeutic stocking 10, a longitudianl slit is formed whether by use of a blade or hot wire which extends from the terminal end of the welt 20 downwardly to a position above the knee area of the stocking with additional fabric in the knitted stocking being removed, if desirable, to accommodate and cooperatively receive as an insert, the flexible and relatively non-elastic welt panel 17. As shown in FIG. 3, the panel 17 is shown in the welt portion wherein the upper section 37 extends about the perimeter for less than 180° and the insert panel converges downwardly to the rounded portion 21. The upper portion of the stocking shown in FIG. 3 is in the inverted condition presenting the portion of the insert panel that will contact the inner and upper thigh portion of the leg of a wearer. The upper terminal edge 38 of the panel insert 17 is coterminous with the terminal portion 20 of the welt and is provided with a binding seam 39 to retain the plies 40 and 41 together at their upper extremities. As shown in FIG. 4, the inner ply 40 is made of polyurethane foam in the form of a relatively thin sheet for positioning against the inner and upper thigh area on the leg of a wearer. The outer ply 41 that has the same configuration as the inner ply 40 is preferably a single ply of warp knit nylon fabric that is relatively non-stretchable or non-elastic since it is knit with untextured or flat feeder yarns or it may be woven of nylon non-stretchable or untextured yarns. The two plies, 40 and 41, are laminated by standard means (adhesion or flame) and joined by overedge seaming which forms the binding seam 42 which is illustrated in the substantailly V-shaped outline 43 in FIG. 3. The overedge seam 42 does not contact the leg of the wearer since it is intended to be formed and postioned on the exterior surface of the stocking. The actual configuration of the welt insert panel may vary depending upon the area or surface to be covered and protected with the desired compressive or retractive force.

It will be readily apparent that other types of cushioning or padding may be utilized in palce of the polyurethane foam ply 40 but it is desirable to have the insert panel welt 17 relatively inelastic but highly flexible and soft for engagement with the upper inner thigh area on the leg of a wearer.

I claim:

1. A circular knit therapeutic stocking having foot, leg and welt portions, said foot, leg and welt portions having alternate wales with stitches of non-elastomeric yarn and intermediate wales in which alternate stitches of non-elastomeric yarn connect with intermediate stitches of bare elastomeric yarn in each said intermediate wale, said bare elastomeric yarn stitches being substantially dominated by said non-elastomeric yarn stitches whereby said bare elastomeric yarn stitches are protected by said non-elastomeric yarn stitches from direct contact with the leg of a wearer while providing graduated compessive force on the leg of a wearer, said foot portion having a closed toe portion, said welt portion of said stocking having an upper terminal portion and a longitudinal slit providing opposed edges, a flexible relatively non-stretchable downwardly-converging panel secured to said slit opposed edges in the welt portion, said panel extending at the upper terminal portion for less than 180° and converging downwardly, said panel engaging the inside of the upper thigh of the leg of a wearer.

2. a circular knit therapeutic stocking as claimed in claim 1, said toe portion having an integrally knit circumferential band of knit stretchable non-elastomeric fabric, and said panel having at least one soft ply of polyurethane foam to engage the inside of the upper thigh of the leg of a wearer.

3. A circular knit therapeutic stocking as claimed in claim 1, said flexible panel having two plies, one of said plies being an inner ply layer of relatively thin and soft polyurethane foam, and an outer ply layer of fabric of untextured nylon yarns, said inner and outer plies being securely fastened to each other and to the opposed edges in the welt whereby the foam ply will engage the inside upper thigh area of the leg of a wearer.

4. A circular knit therapeutic stocking as claimed in claim 1, said intermediate bare elastomeric yarn stitches and alternate non-elastomeric yarn stitches form intermediate courses, said intermediate bare elastomeric yarn stitches being connected continuously by a floated stitch of the same bare elastomeric yarn extending across alternate non-elastomeric stitches, and said relatively non-stretchable panel in the welt portion having two plies, an inner ply layer of relatively thin and soft polyurethane foam, and an outer ply layer of warp knit fabric of untextured nylon yarns, said inner and outer plies being securely fastened to each other and to the opposed edges in the welt whereby the foam will engage the inside upper thigh of the leg of a wearer.

* * * * *